US006554576B2

(12) United States Patent
Rennett et al.

(10) Patent No.: US 6,554,576 B2
(45) Date of Patent: Apr. 29, 2003

(54) MAGNETICALLY COUPLED AND SELF-LUBRICATED PUMP WITH BEARING BURNOUT PROTECTION

(75) Inventors: Ulrich Rennett, Schwalmtal (DE); Manfred Sett, Kempen (DE); Alfred Mersch, Duisburg (DE)

(73) Assignee: ITT Richter Chemie-Technik GmbH, Kempen (DE)

( * ) Notice: Subject to any disclaimer, the term of this patent is extended or adjusted under 35 U.S.C. 154(b) by 0 days.

(21) Appl. No.: 09/862,526

(22) Filed: May 22, 2001

(65) Prior Publication Data

US 2001/0043865 A1 Nov. 22, 2001

(30) Foreign Application Priority Data

May 22, 2000 (DE) ..... 100 24 953

(51) Int. Cl.[7] ..... F04B 49/00

(52) U.S. Cl. ..... 417/44.1; 47/368; 47/420; 47/423.13

(58) Field of Search ..... 417/420, 423.11, 417/423.12, 423.13, 44.1, 44.4, 368, 423.8, 423.14

(56) References Cited

U.S. PATENT DOCUMENTS 4,854,823 A * 8/1989 Hatting et al. ..... 417/63

FOREIGN PATENT DOCUMENTS

| | | |
|---|---|---|
| DE | 57 52 249 | 5/1979 |
| DE | 37 04 671 | 8/1988 |
| DE | 42 12 982 | 10/1993 |
| DE | 93 16 897 | 9/1994 |

OTHER PUBLICATIONS

T400 E Manual, Dec. 21, 1999, Internet Publication, 12 pages.*

* cited by examiner

*Primary Examiner*—Charles G. Freay
*Assistant Examiner*—John Belena
(74) *Attorney, Agent, or Firm*—Herbert Dubno; Andrew Wilford

(57) ABSTRACT

A pump has a housing plate having a front face and a back face, a housing can fixed to the plate and defining a chamber on the back face thereof, a bearing sleeve in the can fixed to the plate and extending rearward from the back face thereof along an axis, and a rotor shaft extending axially through the sleeve and having a front end and a rear end. Bearings support the rotor shaft in the sleeve for rotation therein about the axis. The shaft has an outer surface spaced a predetermined inner radial distance from an inside surface of the bearing sleeve. An impeller is carried on the rotor-shaft front end in a pump chamber at the front face of the housing plate. A rotor body fixed to the shaft rear end extends axially forward in the can around the bearing sleeve. The rotor body has an outer surface spaced a predetermined outer radial distance from an inside surface of the can. The inner radial distance is substantially smaller than the outer radial distance.

5 Claims, 2 Drawing Sheets

MAGNETICALLY COUPLED AND SELF-LUBRICATED PUMP WITH BEARING BURNOUT PROTECTION

FIELD OF THE INVENTION

The present invention relates to a pump. More particularly this invention concerns a magnetically coupled and self-lubricated can-type pump.

BACKGROUND OF THE INVENTION

A standard magnetically coupled can-type pump has a housing plate having a front face and a back face, a can fixed to the plate and defining a chamber on the back face thereof, and a bearing sleeve in the can fixed to the plate and extending rearward from the back face thereof along an axis. A rotor shaft extending axially through the sleeve is supported by bearings in the sleeve for rotation therein about the axis. An impeller is provided on a front end of the rotor shaft in a pump chamber at the front face of the housing plate. A rotor body fixed to a rear end of the shaft extends axially forward in the can around the bearing sleeve. It carries a plurality of permanent magnets that coact with another rotor or stator outside the can to rotate the impeller.

No electricity flows in the rotor of the pump to create a shock hazard so that it can run wet. The interior of the can is filled with the liquid being moved by the pump, for instance coolant water or lubricating oil. The rotor body is formed with one or more axially throughgoing passages and radially extending vanes are provided on the rear end of the rotor body. As the rotor spins, the vanes project fluid outward, pulling more axially in through the rotor body and thereby cooling and/or lubricating it and its bearings.

Such radial vanes have only limited pumping capacity at high pressure. Making them bigger, while it increases the volume of liquid moved, increases the amount of cavitation and the load on the rotor, decreasing pump efficiency. Furthermore the liquid is moved most forcibly between the rear end of the pump and the can, not in the central region of the body where such movement is most needed.

When the bearings are not adequately cooled and/or lubricated, they can burn out. Such failure, if not detected, can lead to offcenter rotation of the rotor so that it comes in contact with the can and destroys the entire pump.

OBJECTS OF THE INVENTION

It is therefore an object of the present invention to provide an improved magnetically coupled rotary canned pump.

Another object is the provision of such an improved magnetically coupled rotary canned pump which overcomes the above-given disadvantages, that is which ensures good pumping of the coolant/lubricant through the rotor.

A further object is to provide a pump that is not liable to bearing burnout and the typically following catastrophic failure.

SUMMARY OF THE INVENTION

A pump has according to the invention a housing plate having a front face and a back face, a housing can fixed to the plate and defining a chamber on the back face thereof, a bearing sleeve in the can fixed to the plate and extending rearward from the back face thereof along an axis, and a rotor shaft extending axially through the sleeve and having a front end and a rear end. Bearings support the rotor shaft in the sleeve for rotation therein about the axis. The shaft has an outer surface spaced a predetermined inner radial distance from an inside surface of the bearing sleeve. An impeller is carried on the rotor-shaft front end in a pump chamber at the front face of the housing plate. A rotor body fixed to the shaft rear end extends axially forward in the can around the bearing sleeve. The rotor body has an outer surface spaced a predetermined outer radial distance from an inside surface of the can. The inner radial distance is substantially smaller than the outer radial distance.

Thus with this system if one of the bearings fails, the maximum the rotor can move radially is the small radial distance, so the outside of the rotor cannot contact the inside of the can. Substantial damage to the pump is thus avoided since the external stator and can remain perfectly preserved. If the bearings are carried according to the invention in removable rings set in the rotor body, they can be replaced with these rings so that the rotor body itself is preserved.

According to the invention at least one temperature sensor is provided adjacent one of the bearings for detecting bearing failure. This sensor is connected to a controller having, in turn, means for making a visible or acoustic alarm to indicate this early stage of bearing failure when friction causes heating.

An electric motor in accordance with the invention that is magnetically coupled to the rotor rotates same about the axis. The controller detects excessive current consumption of the motor and thereby detects bearing failure. This is a second way of averting catastrophic failure by sensing early signs of bearing failure, namely friction causes an increase in the load on the drive motor.

The pump according to the invention has a vane on the rotor for pumping liquid from inside the can axially through the bearings on rotation of the rotor about the axis.

According to another aspect of the invention the rotor body has an outer surface confronting an inner surface of the bearing sleeve and defining therewith an annular and axially extending space. One of the surfaces is formed with a helicoidal groove open toward the other of the faces. When the body rotates relative to the bearing sleeve, the groove pumps liquid axially through the bearing.

There are two such bearings spaced axially on the shaft. The rotor body is formed at each of the sleeves with the groove. In addition the groove, which is typically formed in the rotor body, has an axial outer end open outside the sleeve and an axially inner end open inside the sleeve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
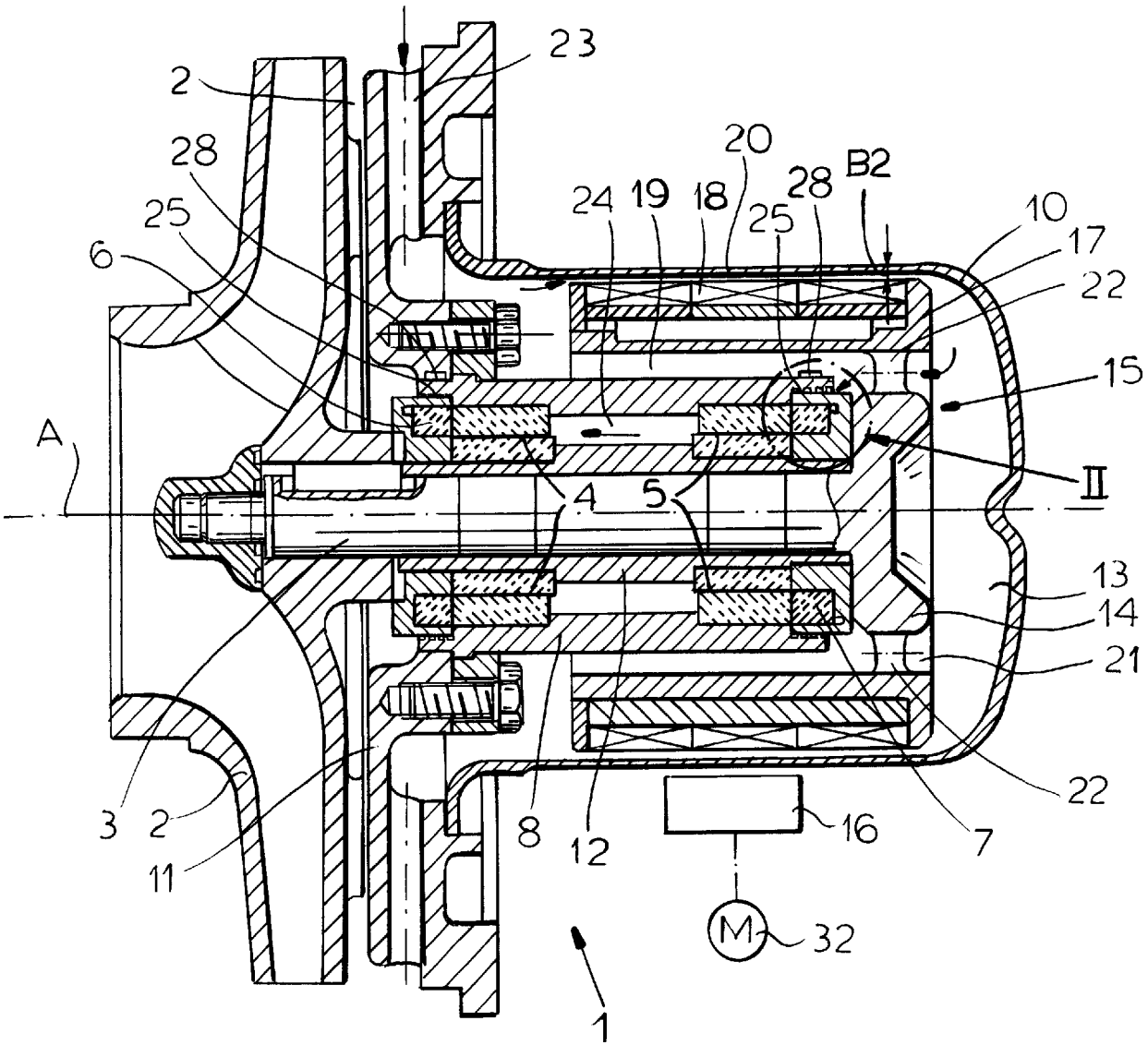
FIG. 1 is a partly diagrammatic axial section through the pump according to the invention.
Figure 2:
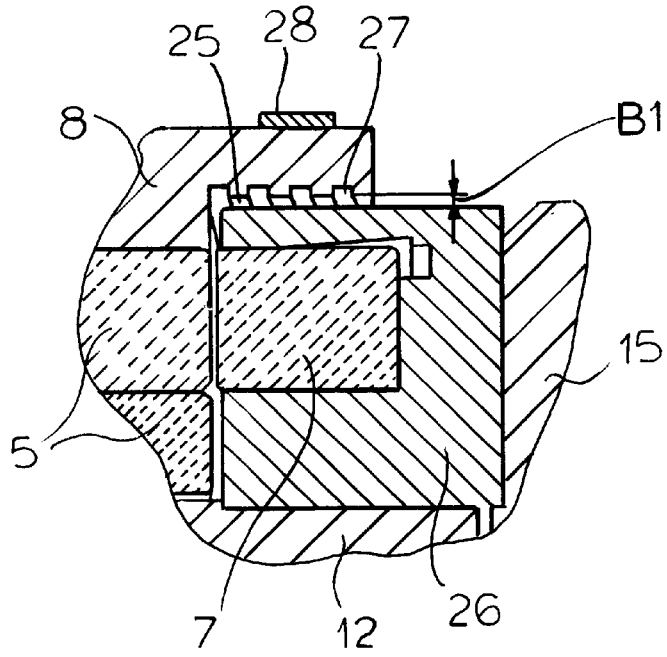
FIG. 2 is a large-scale view of the detail indicated at II in FIG. 1.

As seen in FIG. 1 a rotary pump 1 has an axial-input radial-output impeller 2 carried on a front end of a shaft 3 of a magnetically driven rotor 14 and rotatable thereby about an axis A. The shaft 3 extends axially through a stationary housing wall 11 on whose front side is a pump chamber 9 holding the impeller 2 and on whose back side is secured a closed dielectric can 10 surrounding the rotor 14. A bearing sleeve 8 is fixed to the wall 11 and extends outward therefrom along the axis A and another sleeve 12 fixed to and surrounding the shaft 3 lies coaxially in the sleeve 8.

The rotor 14 is supported on the sleeve 8 by two-part ceramic radial-force bearings 4 and 5 flanked by two ceramic axial-force end bearings 6 and 7. The end bearings 6 and 7 are set in respective mounting rings 26 fixed on the sleeve 12. The bearings 4 and 5 engage the shaft sleeve 12 and allow the rotor 14 to rotate freely about the axis A. The rotor 14 has a rear end 15 connected to the rear end of a cup-shaped magnet holder or body 17 that coaxially surrounds the rear end of the bearing sleeve 8 and that carries a plurality of permanent magnets 18 that cooperate with a drive element 16 that is rotated about the axis A outside the can 10 by a motor shown schematically at 32. The rotor body 17 defines with the bearing sleeve 8 an axially extending annular space 19 and, with the can 10 an axially extending annular space 20. The front ends of the spaces 19 and 20 communicate with the pump chamber 9 via a passage 23 and their rear ends open into a chamber 13 defined between the inner face of the end of the can 10 and the rear face of the rotor body 17. An annular and axially extending inner space 24 holding the bearings 4 through 7 is defined between the rotor sleeve 12 and the housing sleeve 8

An annular passage 21 connects the rear end of the space 19 with the chamber 13 at the rear end of the can 10. The passage 21 is provided with two to four, here three, angled vanes 22 that extend at angles of between 5° and 15° to respective planes including the axis A. Thus, when the rotor 14 turns in a standard forward direction, the vanes 22 draw liquid in from the chamber 13 and force it not only forward through the space 19, but inward into the space 24 between the housing sleeve 8 and the rotor sleeve 12. This serves to lubricate and/or cool the bearings 4 through 7. This action is augmented by a spiral groove 27 formed either on the inner surface of the sleeve 8 or on the facing outer surface of the sleeve 12 level with the rear bearing 7, that is at the axial rear inlet end of the passage 24. The hand of the groove 27 is such that on normal rotation of the pump it draws liquid in and from the passage 19 and forces it axially forward through the passage 24.

According to the invention the radial outer surface of the ring 26 of the rotor 14 is spaced inward from the radial inner surface of the housing sleeve 8 by a gap 25 or a relatively small radial distance B1 that is smaller than a radial distance B2 between the radially outwardly directed outer surface of the rotor 14 and the radially inwardly directed inner surface of the can 10. Thus if one of the bearings 4 through 7 fails so that the gap 25 closes, the rotor 14 will not move radially enough, even if running eccentrically, to touch the inner surface of the can 10.

Figure 3:
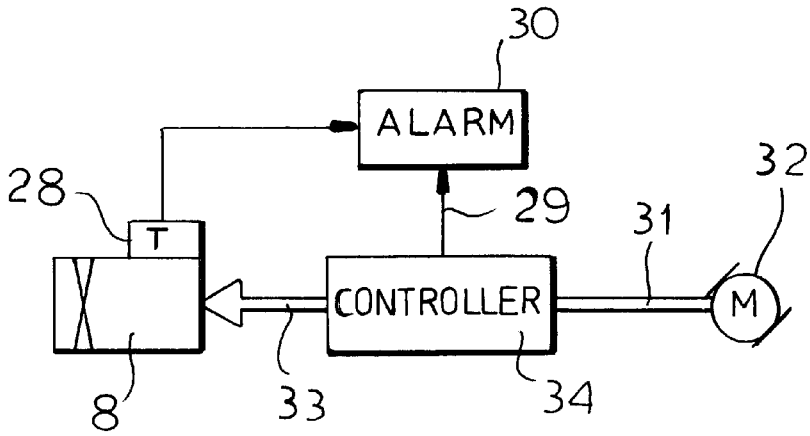
FIG. 3 is a schematic view illustrating the instant invention.

In addition the housing sleeve 8 is provided level with each of the end bearings 6 and 7 on its outer surface with temperature sensors 28. As shown in FIG. 3 a controller 34 is connected via a line 31 to the drive motor 32, via a line 29 to an alarm or display 30, and via another line 33 to the sensor 28. The controller 29 monitors the current consumption of the motor 32, which increases if one of the bearings 4 through 7 burns out, and also the temperature at the sensors 28, which will increase markedly if one of the bearings 4 through 7 burns out. Thus the system can detect the friction that characteristically presages failure of one of the bearings 4 through 9.

We claim:

1. A pump comprising:

a housing plate having a front face and a back face;

a housing can fixed to the plate and defining a chamber on the back face thereof;

a bearing sleeve in the can fixed to the plate and extending rearward from the back face thereof along an axis;

a rotor shaft extending axially through the sleeve and having a front end and a rear end;

bearings supporting the rotor shaft in the sleeve for rotation therein about the axis, the shaft having an outer surface spaced a predetermined inner radial distance from an inside surface of the bearing sleeve;

an impeller on the rotor-shaft front end in a pump chamber at the front face of the housing plate; and a rotor body fixed to the shaft rear end and extending axially forward in the can around the bearing sleeve, the rotor body having an outer surface spaced a predetermined outer radial distance from an inside surface of the can, the inner radial distance being smaller than the outer radial distance.

2. The pump defined in claim 1, further comprising:

control means including at least one temperature sensor adjacent one of the bearings for detecting bearing failure.

3. A pump comprising:

a housing plate having a front face and a back face;

a housing can fixed to the plate and defining a chamber on the back face thereof;

a bearing sleeve in the can fixed to the plate and extending rearward from the back face thereof along an axis;

a rotor shaft extending axially through the sleeve and having a front end and a rear end;

bearings supporting the rotor shaft in the sleeve for rotation therein about the axis, the shaft having an outer surface spaced a predetermined inner radial distance from an inside surface of the bearing sleeve;

an impeller on the rotor-shaft front end in a pump chamber at the front face of the housing plate;

a rotor body fixed to the shaft rear end and extending axially forward in the can around the bearing sleeve, the rotor body having an outer surface spaced a predetermined outer radial distance from an inside surface of the can, the inner radial distance being smaller than the outer radial distance;

an electric motor magnetically coupled to the rotor for rotating same about the axis; and control means for detecting excessive current consumption of the motor and thereby detecting bearing failure.

4. The pump defined in claim 1, further comprising:

means including a vane on the rotor for pumping liquid from inside the can axially through the bearings on rotation of the rotor about the axis.

5. The pump defined in claim 1 wherein the pump includes removable rings carrying the bearings.

* * * * *